United States Patent [19]

Mason

[11] Patent Number: 4,823,466

[45] Date of Patent: Apr. 25, 1989

[54] SLABBER DEVICE

[76] Inventor: William C. Mason, 429 Freeman Rd., Cloquet, Minn. 55720

[21] Appl. No.: 115,978

[22] Filed: Nov. 2, 1987

[51] Int. Cl.[4] ..... B26B 5/00

[52] U.S. Cl. ..... 30/344; 30/329

[58] Field of Search ..... 225/93; 30/329, 342, 30/344; 83/924; 28/295

[56] References Cited

U.S. PATENT DOCUMENTS

| | | | |
|---|---|---|---|
| 22,527 | 1/1859 | Chapman | 30/342 X |
| 68,307 | 8/1867 | Neff | 30/342 X |
| 886,809 | 5/1908 | Howell | 30/342 X |
| 4,620,369 | 11/1986 | Gercken | 30/344 X |

*Primary Examiner*—Frank T. Yost
*Assistant Examiner*—Michael D. Folkerts
*Attorney, Agent, or Firm*—Merchant, Gould, Smith, Edell, Welter & Schmidt

[57] ABSTRACT

A slabber device is disclosed including a handle and a replacable tip.

1 Claim, 1 Drawing Sheet

SLABBER DEVICE

FIELD OF THE INVENTION

The present invention relates to cutting or tearing devices and more particularly to a tool for tearing layers of paper from a roll of paper, e.g., a spent roll of paper, thereby cleaning the core.

BACKGROUND OF THE INVENTION

A wide variety of devices have been used in the past for cutting or tearing paper. Typically such devices include scissors and knives. In many instances the tool is specially designed for a specific purpose. The present invention comprises such a dedicated tool.

In the manufacture of paper, it is commonly produced in an endless or continuous web. The paper comes wrapped onto a core. When the end user first begins using paper from a roll, several outer layers of paper must be removed. For example, such outer layers may be soiled or damaged.

Often the cores are of substantial material which are suitable for reuse by the paper manufacturer. As the paper is consumed by the end user, it is stripped from the roll. When a relatively few layers remain on the core, the end user or the paper company may strip the paper to effectively clean the core of paper. For many years, a device has been used for this purpose. The device has been made of wood, generally Maple. The wood is approximately ⅜ inch in thickness, has a first edge that is straight and a second edge that follows a sine wave path to provide a sharp, pointed end and an enlarged handle portion. The handle portion tends to be durable and is rarely worn or broken. On the other hand, the sharp, pointed portion is relatively weak and is worn away, splintered, or broken. Various attempts have been made to overcome the problem. One approach has been to use a knife and carve a new sharp end. However, the new end likewise becomes broken, chipped and splintered. Very shortly, there is only a handle remaining, which is not suitable for use in stripping paper from the core. The handle is then discarded and a new device is obtained.

In the present invention, it was discovered that one may provide a stripping device including a handle and a replaceable end portion. However, the application of a removable end portion to such a device is not readily accomplished. Due to the manner in which the device is used, namely, pounding and driving it through the paper layers, a great deal of torque results. It is not uncommon in use to break a tip due to such torque, thus it has not appeared feasible in the past to provide such a tool with a replaceable tip. The present invention overcomes this problem by providing a tongue and groove connection of substantial depth and by having the force transmitted through cooperating shoulders with close tolerances.

IN THE DRAWINGS

DETAILED DESCRIPTION

Figure 1:
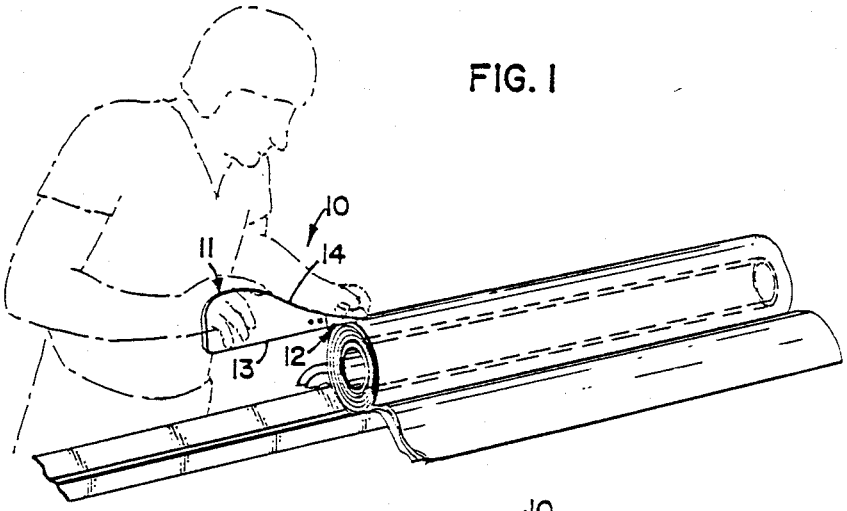
FIG. 1 is a perspective view of the invention.
Figure 2:
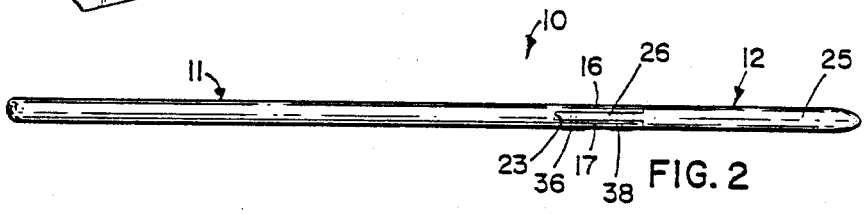
FIG. 2 is a top plan view of the invention.
Figure 3:
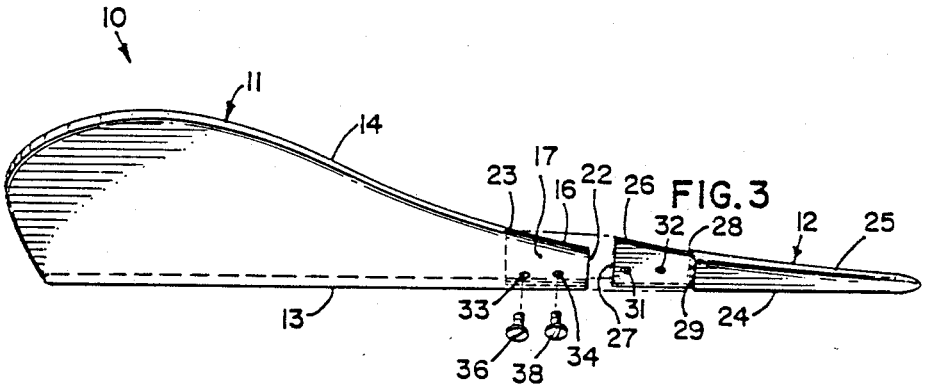
FIG. 3 is an exploded perspective view of the present invention.
Figure 4:
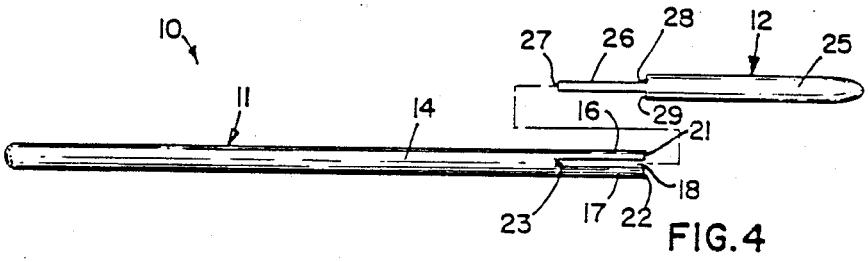
FIG. 4 is a top exploded plan view of the present invention.

The shoulder 10 of the present invention (FIGS. 1–4) includes a handle 11 and a tip 12. The handle 11 and tip 12 may be constructed of wood such as Maple. Such construction may be of wood stock having a thickness of about ⅜ inch. The handle 11 may have a straight lower edge 13 and an arcuate upper edge 14. The handle 11 has a pair of plate-like portions 16 and 17 which define a groove 18 therebetween. The plate-like portions 16 and 17 include a forward shoulder 21 and 22 respectively. A groove shoulder 23 is defined between the plate 16 and 17 for purposes hereinafter described.

The tip 12 has a straight lower edge 24 which corresponds with the straight lower edge 13 of handle 11. The tip 12 has a ramp-like upper surface 25 which slopes upwardly and rearwardly to mate with the surface 14 as illustrated in FIG. 1. The tip 12 has a tongue 26 which snuggly and tightly fits into the groove 18. The cross-sectional dimension of tongue 26 desirably is within 1/100-inch of the cross-sectional dimension of the groove 18. The tongue 26 has a rear edge 27 which snuggly and uniformly engages the shoulder 23 of groove 18. The tip 12 further includes a pair of shoulders 28 and 29 which, in the assembled position, snuggly and uniformly engage the shoulders 21 and 22 of handle 11. The tongue 26 is provided with a pair of openings 31, 32 which correspond with openings 33, 34 in the handle 11. Suitable screws 36, 38 are inserted into such openings to secure the tip 12 to the handle 11.

While a preferred embodiment of the present invention has been disclosed, various modifications can be made without departing from the broader scope of the invention. For example, while it is highly desirable that the slabber be constructed of Maple, it may alternatively be constructed of a man-made material.

What is claimed is:

1. A slabber comprising a plate-like tool having a straight lower edge and an arcuate upper edge, said arcuate upper edge having a first portion comprising a convex surface and a second portion comprising a concave portion, said second portion ending in a ramp-like pointed end, said slabber comprising two members, one of said members being a handle portion and the other member being a disposable tearing portion, said other member providing said ramp-like pointed end, said one member and said other member being joined by a tongue and groove interconnection, said one member including a groove portion and said other member including a tongue portion, said groove portion of said one member having a pair of shoulders and said other member having a pair of shoulders and wherein said shoulders of said one member bear directly on the corresponding shoulders of said other member, a pair of screws extending through said tongue portion and said groove portion to bind said members together, said handle portion and said tearing portion being constructed of wood, said plate-like tool having a thickness of about ⅜-inch, said handle portion having a deep vertically oriented groove along a forward edge, said tearing portion having a vertically oriented tongue, said tongue tightly and fully fitting in said groove, said groove providing a pair of vertical outer shoulders and said tearing portion having a pair of mating shoulders at the forward portion of said tongue, whereby force transmitting from said tip to said handle is transmitted through said shoulders and wherein said tearing portion may be discarded and replaced with a like portion upon being chipped or broken.

* * * * *